US007293928B2

(12) United States Patent
Lane

(10) Patent No.: US 7,293,928 B2
(45) Date of Patent: Nov. 13, 2007

(54) TOOTHPASTE DISPENSING TOOTHBRUSH

(76) Inventor: Gary S. Lane, P.O. Box 20012, Sarasota, FL (US) 34276

( * ) Notice: Subject to any disclaimer, the term of this patent is extended or adjusted under 35 U.S.C. 154(b) by 0 days.

(21) Appl. No.: 11/443,606

(22) Filed: May 31, 2006

(65) Prior Publication Data

US 2006/0269354 A1 Nov. 30, 2006

Related U.S. Application Data

(60) Provisional application No. 60/685,897, filed on May 31, 2005.

(51) Int. Cl.
*B43M 11/06* (2006.01)
*A46B 11/00* (2006.01)

(52) U.S. Cl. ..... 401/184; 401/183; 401/123

(58) Field of Classification Search ..... 401/183–186, 401/118–125, 268–270, 274, 275, 280
See application file for complete search history.

(56) References Cited

U.S. PATENT DOCUMENTS 1,461,922 A * 7/1923 Little ..... 401/184
1,701,030 A * 2/1929 Collins ..... 401/278
3,734,118 A * 5/1973 Howard ..... 132/311
4,269,207 A 5/1981 Konrad et al.
5,028,158 A 7/1991 Fey
5,066,155 A * 11/1991 English et al. ..... 401/175
5,244,298 A * 9/1993 Greenhouse ..... 401/191
6,050,736 A 4/2000 Gonzalez
6,685,375 B1 2/2004 Crocker
6,793,433 B2 9/2004 Giraldo

* cited by examiner

*Primary Examiner*—David J. Walczak
(74) *Attorney, Agent, or Firm*—James Ray & Assoc.

(57) ABSTRACT

A toothpaste dispensing toothbrush includes an elongated member and a brush section affixed to a first end of the elongated member. An elongated container is coupled to the elongated member and an outer surface of the predetermined portion and an outer surface of the container form a handle portion of the toothbrush. The container includes a housing, a chamber formed within the housing for containing toothpaste and an aperture formed within a first end of the container and in communication with the chamber for dispensing such toothpaste into the brush section when a manual force is applied to a wall portion of the container. A pair of projections formed in the elongated member and a pair of cavities formed in the container are provided for securing the container to the elongated member in a position for dispensing such toothpaste into the brush section.

20 Claims, 2 Drawing Sheets

TOOTHPASTE DISPENSING TOOTHBRUSH

CROSS-REFERENCE TO RELATED APPLICATIONS

This application is related to and claims priority from Provisional Patent Application Ser. No. 60/685,897 filed May 31, 2005.

FIELD OF THE INVENTION

The present invention relates, in general, to brushing and scrubbing devices for teeth and, more particularly, this invention relates to a toothpaste dispensing toothbrush having an integrated toothpaste container.

BACKGROUND OF THE INVENTION

Toothbrushes with combined toothpaste containers are generally well known in the art. U.S. Pat. No. 6,793,433 to Giraldo, U.S. Pat. No. 6,685,375 to Crocker, U.S. Pat. No. 5,028,158 to Fey and U.S. Pat. No. 4,269,207 to Konrad et al disclose various types of such toothbrushes. However, a common disadvantage of the presently available toothbrushes is related to a complex construction which is required in order to attach a toothpaste container to the brush portion and to dispense the toothpaste therefrom. Such complex construction increases the cost of manufacturing toothbrushes. Furthermore, the prior art toothbrushes employ a single use toothpaste container, which increases the cost of using such toothbrushes.

For example, U.S. Pat. No. 4,269,207 discloses a threaded attachment of the toothpaste container to the brush portion and a plunger mechanism operable by a manually rotatable wheel mounted for rotation on the outer end of the toothpaste dispenser.

U.S. Pat. No. 6,685,375 to Crocker, provides a snap-in connection between the brush portion and the toothpaste container and a toothpaste injecting piston which is operable by a pad mounted for sliding movement on the outer surface of the toothpaste container.

U.S. Pat. No. 6,793,433 to Giraldo discloses a toothpaste containing cartridge which is inserted into the hollow handle of the toothbrush assembly and which is connected by a passageway with the brush portion of the toothbrush assembly.

SUMMARY OF THE INVENTION

The present invention provides a toothpaste dispensing toothbrush. Such toothbrush includes an elongated member having a first end, an opposed second end and a predetermined portion starting at the second end and extending towards the first end forms a part of the handle. A brush section is affixed to the first end of the elongated member. An elongated container is coupled to the predetermined portion of the elongated member. A longitudinal axis of the container is parallel to a longitudinal axis of the elongated member. An outer surface of the predetermined handle portion and an outer surface of the container form, in combination, the handle portion of the toothbrush. The container includes a housing, a chamber formed within the housing for containing toothpaste and an aperture formed within a first end of the container and being in communication with the chamber for dispensing such toothpaste into the brush section when a manual force is applied to a wall portion of the container. A locking means is provided for securing the container to the elongated member in a position for dispensing such toothpaste into the brush section.

OBJECTS OF THE INVENTION

It is, therefore, one of the primary objects of the present invention to provide a toothpaste dispensing toothbrush.

Another object of the present invention is to provide a toothpaste dispensing toothbrush which is economical to manufacture.

Yet another object of the present invention is to provide a toothpaste dispensing toothbrush which is simple to use.

A further object of the present invention is to provide a toothpaste dispensing toothbrush which enables the user to reuse the toothpaste container.

Yet a further object of the present invention is to provide a toothpaste dispensing toothbrush which enables simple cleaning of the toothpaste container.

An additional object of the present invention is to provide a toothpaste dispensing toothbrush which includes a cover protecting the brush section for sanitary purposes.

Another object of the present invention is to provide a toothpaste dispensing toothbrush which is convenient to carry.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
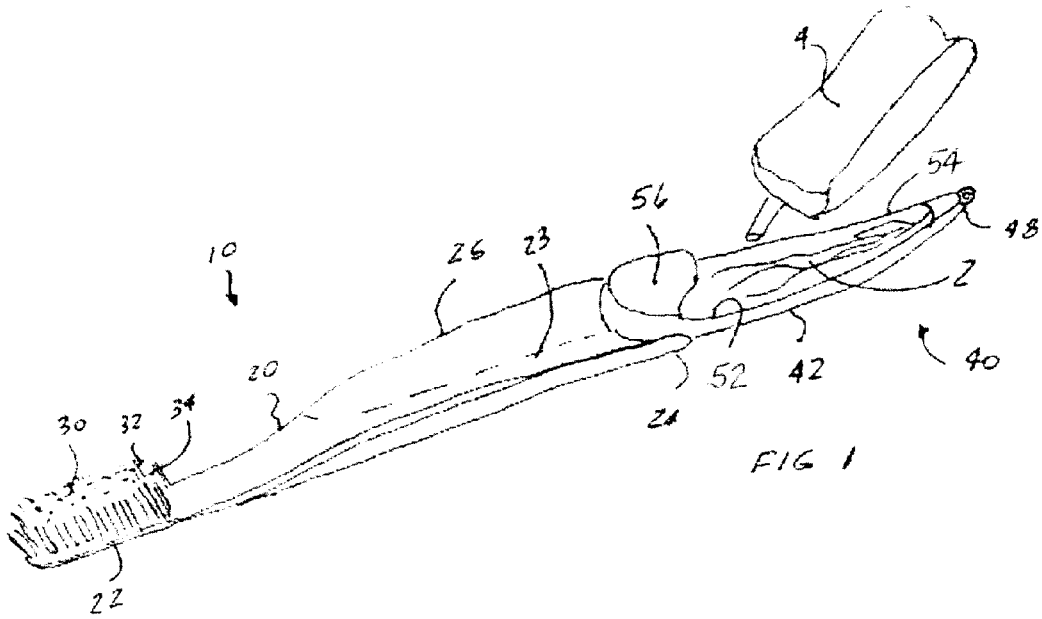
FIG. 1 is a perspective view of a toothpaste dispensing toothbrush of the present invention.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
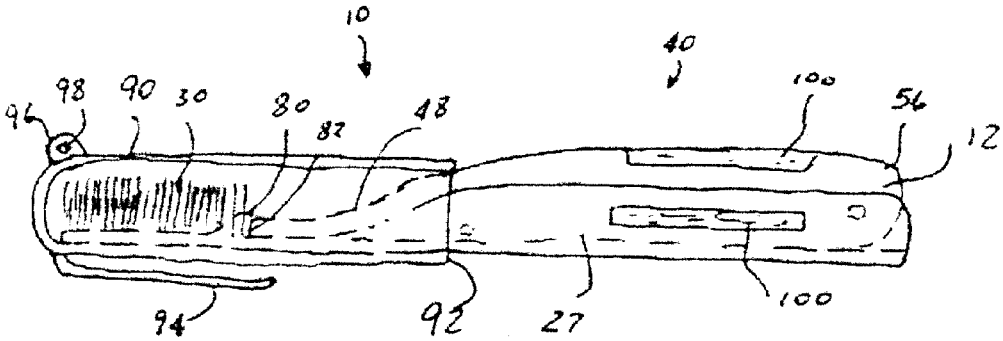
FIG. 2 is a side elevation view of the toothpaste dispensing toothbrush of FIG. 1.
Figure 3:
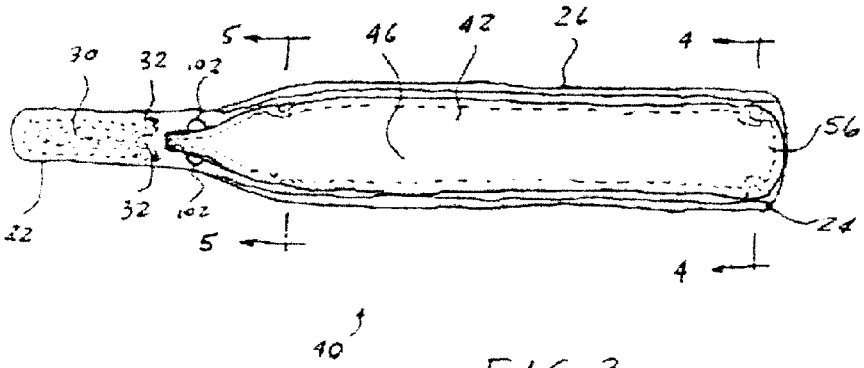
FIG. 3 is a plan view of the toothpaste dispensing toothbrush of FIG. 1.

Reference is now made, to FIGS. 1-3, wherein there is shown a toothpaste dispensing toothbrush, generally designated 10. The toothbrush 10 includes an elongated member 20 having a first end 22, an opposed second end 24 and a predetermined portion 26 starting at the second end 24 and extending towards the first end 22. Preferably, the predetermined portion 26 of the elongated member 20 is formed as a generally C-shaped portion. It is further presently preferred that such predetermined portion 26 is manufactured from a generally rigid plastic material.

A brush section 30 is affixed to a first end 22 of the elongated member 20.

An elongated container, generally designated 40, is coupled to the predetermined portion 26 of the elongated member 20 in an arrangement, wherein a longitudinal axis of the container 40 is parallel to a longitudinal axis of the elongated member 20. An outer surface 27 of the predetermined portion 26 and an outer surface 44 of the container 40 form, in combination, a handle portion 12 of the toothbrush 10.

A locking means, generally designated 60, is provided for securing container 40 to the elongated member 20 in a position to dispense such toothpaste 2 into the brush section 30.

According to one embodiment of the invention, the container 40 includes a housing 42 having such outer surface 44, a closed chamber 46 which is formed within the housing 42 for containing a toothpaste 2 and an aperture 50 formed within a first end 48 of the container 40 and in communication with the chamber 46 for dispensing such toothpaste 2 into the brush section 30 when a predetermined manual force is applied to a predetermined wall portion of the container 40.

Such predetermined wall portion of the container 40 is preferably formed from a softer plastic and has a predetermined flexibility to facilitate dispensing of the toothpaste 2. It will be understood, that the container 40 having a closed chamber 46 will be pre-filled with the toothpaste 2 prior to attachment to the elongated member 20 which is advantageous for providing a disposable type toothpaste container 40. Therefore, a user of such toothbrush 10 will have to simply install a new container 40 to continue using such toothbrush 10.

Now refer to FIG. 1. Illustrated therein is another embodiment of the invention, wherein a potion of the wall 52 of the housing 42 has been removed thus forming a partially open chamber 46 having a predetermined shape and a peripheral edge 54.

By way of example in FIG. 1, such toothpaste is deposited from a well known toothpaste holder 4. The edge 54 is oriented towards and abuts an inner surface of the predetermined portion 26 of the elongated member 20 when the container 40 is disposed in the position for dispensing such toothpaste 2.

In order to deposit the toothpaste 2 into the partially open chamber 46, a pivot means, generally designated 70, is provided for pivotally connecting a closed second end 56 of the container 40 to a second end 24 of the elongated member 20, whereby the container 40 is pivotally movable in a first direction into position for closing the partially open chamber 46 and for dispensing such toothpaste 2 into the brush section 30 and pivotally movable in an opposed second direction for exposing the partially open chamber 46 to receive such toothpaste 2.

Figure 4:
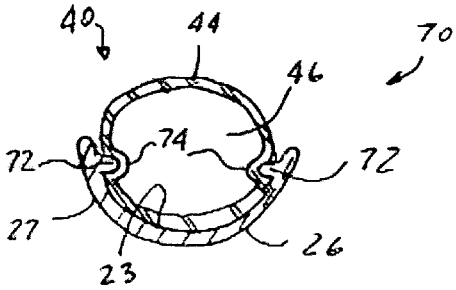
FIG. 4 is a cross-sectional view of the toothpaste dispensing toothbrush taken along the lines 4-4 of FIG. 3.

Referring to FIG. 4, the pivot means 70 of the presently preferred embodiment, includes a pair of projections 72 disposed in the second end 24 and formed in the inner surface 23 of the elongated member 20 and a pair of complimentary cavities 74 disposed in the outer surface 44 of the container 40, each cavity 74 is aligned and engageable with a respective one of the pair of projections 72.

It will be apparent to those skilled in the relevant art, that a partially open chamber 46 enables the user of the toothbrush 10 to simply deposit toothpaste 2 into chamber 46 from the toothpaste holder 4, pivot the container 40 for positioning the first end 48 of container 40 in close proximity to an inward end 32 of the brush section 30 and apply the predetermined manual force, usually by way of a thumb, to the outer surface 44 of the container 40. When the toothpaste 2 has been depleted from the chamber 46, the user simply pivots the container 40 away from the elongated member 20 to expose the open side of the chamber 46 and to replenish the toothpaste 2. When required, the user is further able to clean the chamber 46 and the portion 26 of the elongated member 20.

Figure 5:
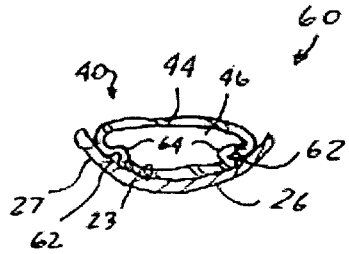
FIG. 5 is a cross-sectional view of the toothpaste dispensing toothbrush taken along the lines 5-5 of FIG. 3.

Now in reference to FIG. 5, therein is shown the presently preferred locking means 60, that will include a pair of projections 62 formed within the inner surface 23 of the predetermined portion 26 of the elongated member 20 and engaging a pair of complimentary cavities 64 disposed in the outer surface 44 of the container 40, each cavity 64 is aligned with a respective one of the pair of projections 62 when the container 40 is disposed in the position for dispensing such toothpaste 2.

To further facilitate dispensing of the toothpaste 2 into the brush section 30, there is a void 34 which is formed within the inwardly disposed end 32 of the brush section 30 and the first end 48 of the container 40 is positioned into the void 34 for dispensing such toothpaste 2.

To prevent unintentional dispensing of the toothpaste 2, the toothbrush 10 may further include an abutment 80 formed in the first end 22 of the elongated member 20 and adjacent the inward end 32 of the brush section 30. The first end 48 of the container 40 will then abut a generally vertical surface 82 of the abutment 80 for sealing the aperture 50. Accordingly, the first end 48 of the container 40 is moved away, for example, by way of pivoting or lifting, from the elongated member 20 and into the position for exposing the aperture 50 and for dispensing such toothpaste 2 into the brush section 30.

Figure 6:
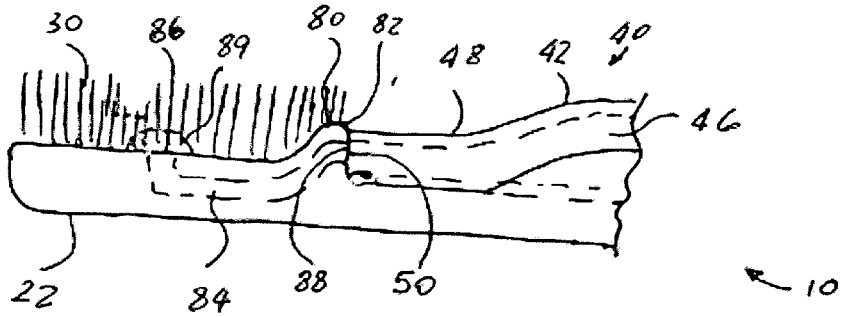
FIG. 6 is a partial side elevation view of the toothpaste dispensing toothbrush of FIG. 1 illustrating an alternative embodiment of dispensing toothpaste.

According to an alternative embodiment of the present invention, best illustrated in FIG. 6, the toothbrush 10 includes such abutment 80 formed adjacent the inward end 32 of the brush section 30. There is a passageway 84 disposed within the first end 22 of the elongated member 20. The passageway 80 has a first end 86 thereof in open communication with the brush section 30 and a second end 88 in open communication with the outer generally vertical surface 82 of the abutment 80.

Accordingly, the aperture 50 of the first end 48 of the container 40 is aligned with the second open end 88 of the passageway 84 when the container 40 is disposed in the position for dispensing such toothpaste 2.

A restraining means, such as, an injector means 89, is connected to the first end 22 and aligned with the first end 86 of the passageway 84 for restraining the dispensing of the toothpaste 2 to only when a predetermined force is applied to the container 40 and for preventing accidental discharge of such toothpaste 2. Such injector 89 may be of a type taught by U.S. Pat. No. 6,685,375 to Crocker, whose teaching is incorporated into this document by reference thereto. Alternatively, a valve means taught in U.S. Pat. No. 6,793,433 to Giraldo may be used. The teaching of U.S. Pat. No. 6,793,433 is incorporated into this document by reference thereto.

To protect the brush section 30 from undesirable elements, such as dust and dirt, and to protect the user from inadvertent contact with the toothpaste 2, the toothbrush 10 further includes a hollow cover member 90 for covering such brush section 30. One end 92 of the cover member 90 is open for frictionally receiving at least a portion of the first end 48 of the container 40. The cover 90 may include a well known pocket clip 94 rigidly attached thereto and may further include a projection 96 and an aperture 98 formed therein for attaching the toothbrush 10 to at least one of a chain and a key ring (not shown).

An anti-slip means 100 may be disposed on at least one of the outer surface 27 of the elongated member 20 and the outer surface 44 of the container 40 for facilitating handling of the toothbrush 10. Such anti-slip means may include a rubber like material at least partially incorporated into toothbrush 10. Furthermore, a grip means, such as a pair of projections 102 engageable with the first end 48 of the container 40, may be provided for moving such container 40 from the position for dispensing such toothpaste 2.

Although the present invention has been shown in terms of the locking the container 40 by way of aligned projections and cavities, it will be apparent to those skilled in the art, that the present invention may employ other means for locking the container 40 in position for dispensing toothpaste 2. For example, such locking means may include a frictional engagement between the outer surface 44 of the container 40 and the predetermined portion 26 of the elongated member 20.

Furthermore, the container 40 may be manufactured from a transparent or translucent material for enabling the user to visually identify an amount of toothpaste 2 remaining in such chamber 46. Advantageously, elongated member 20 and container 40 may be provided in a wide variety of uniform or contrasting colors.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A toothpaste dispensing toothbrush, said toothbrush comprising:

(a) an elongated member having a first end, an opposed second end and a predetermined portion starting at said second end and extending towards said first end;

(b) a brush section affixed to said first end of said elongated member;

(c) an elongated container coupled to said predetermined portion of said elongated member, a longitudinal axis of said container is parallel to a longitudinal axis of said elongated member, an outer surface of said predetermined portion and an outer surface of said container form a handle portion of said toothbrush, and wherein said container includes a housing, a chamber formed within said housing for containing a toothpaste and an aperture formed within a first end of said container and in fluid communication with said chamber for dispensing such toothpaste into said brush section when a predetermined manual force is applied to a predetermined wall portion of said housing; and (d) a locking means for securing said container to said elongated member in a position for dispensing such toothpaste into said brush section, wherein said locking means includes a pair of projections formed on an inner surface of said predetermined portion of said elongated member and engaging a pair of complimentary cavities disposed in said outer surface of said container, each aligned with a respective one of said pair of projections when said container is disposed in said position for dispensing such toothpaste.

2. The toothbrush, according to claim 1, wherein said predetermined portion of said elongated member is formed as a generally C-shaped portion.

3. The toothbrush, according to claim 2, wherein said generally C-shaped predetermined portion of said elongated member is generally rigid.

4. The toothbrush, according to claim 1, wherein a wall portion of said housing has been removed forming a partially open chamber and wherein a peripheral edge of said partially open chamber is oriented towards an inner surface of said predetermined portion of said elongated member when said container is disposed in said position for dispensing such toothpaste.

5. The toothbrush, according to claim 4, wherein said toothbrush includes a pivot means for pivotally connecting a closed second end of said container to said second end of said elongated member, whereby said container is pivotally movable in a first direction into said position for dispensing such toothpaste into said brush section and pivotally movable in an opposed second direction for exposing said partially open chamber for depositing such toothpaste thereinto.

6. The toothbrush, according to claim 5, wherein said pivot means includes a pair of projections disposed in said second end of said elongated member and a pair of complimentary cavities disposed in said outer surface of said container, each aligned and engageable with a respective one of said pair of projections.

7. The toothbrush, according to claim 1, wherein said predetermined wall portion of said container for receiving said predetermined manual force is generally flexible.

8. The toothbrush, according to claim 1, wherein said toothbrush further includes a grip means engageable with said container for moving it from said position for dispensing such toothpaste.

9. The toothbrush according to claim 1, wherein said first end of said container is disposed in close proximity to an inwardly disposed end of said brush section.

10. The toothbrush according to claim 1, wherein said brush section contains a void formed within an inwardly disposed end of said brush section and said first end of said container is positioned for dispensing such toothpaste into said void.

11. The toothbrush according to claim 1, wherein said first end of said elongate member includes an abutment formed within said first end of said elongated member and adjacent an inward end of said brush section and a passageway disposed within said first end of said elongated member, said passageway has a first end thereof in open communication with said brush section and a second end thereof in open communication with an outer generally vertical surface of said abutment, and wherein said aperture of said first end of said container is aligned with said second end of said passageway when said container is disposed in said position for dispensing such toothpaste.

12. The toothbrush according to claim 1, wherein said toothbrush further includes a cover member for covering said brush section, said cover member having an open end thereof for receiving a portion of said first end of said container.

13. The toothbrush according to claim 12, wherein said cover member includes a pocket clip rigidly attached thereto.

14. The toothbrush according to claim 12, wherein said cover member includes a projection and an aperture formed therein for attaching said toothbrush to at least one of a chain and a key ring.

15. The toothbrush according to claim 12, wherein said open end of said cover member frictionally engages an outer surface of said first end of said container.

16. The toothbrush according to claim 1, wherein said toothbrush further includes an abutment formed within said first end of said elongated member and adjacent an inwardly disposed end of said brush section, wherein said first end of said container abuts a generally vertically surface of said abutment for sealing said aperture, and wherein said first end of said container is moved away from said elongated member and into said position for exposing said aperture and for dispensing such toothpaste into said brush section.

17. The toothbrush according to claim 1, wherein said toothbrush further includes an anti-slip means disposed at least on one of said outer surface of said elongated member and said outer surface of said container.

18. A toothpaste dispensing toothbrush, said toothbrush comprising:

(a) an elongated member having a first end, an opposed second end and a predetermined portion starting at said second end and extending towards said first end;

(b) a brush section affixed to said first end of said elongated member; and (c) an elongated container coupled to said predetermined portion of said elongated member, a longitudinal axis of said container is parallel to a longitudinal axis of said elongated member, an outer surface of said predetermined portion of said elongated member and an outer surface of said container form a handle portion of said toothbrush, wherein said container includes a housing having a portion of its wall removed, a partially open chamber formed within said housing for containing a toothpaste and an aperture formed within a first end of said container and in fluid communication with said chamber for dispensing such toothpaste into said brush section when a predetermined manual force is applied to a remaining wall portion of said housing, and wherein a peripheral edge of said partially open chamber is oriented towards and abuts an inner surface of said predetermined portion of said elongated member when said container is disposed in a position for dispensing such toothpaste.

19. The toothbrush, according to claim 18, wherein said toothbrush includes a pair of projections formed on an inner surface of said predetermined portion of said elongated member and engaging a pair of complimentary cavities disposed in said outer surface of said container, each aligned with a respective one of said pair of projections when said container is disposed in said position for dispensing such toothpaste.

20. A toothpaste dispensing toothbrush, said toothbrush comprising:

(d) an elongated member having a first end, an opposed second end and a predetermined portion starting at said second end and extending towards said first end;

(e) a brush section affixed to said first end of said elongated member;

(f) an elongated container coupled to said predetermined portion of said elongated member, a longitudinal axis of said container is parallel to a longitudinal axis of said elongated member, an outer surface of said predetermined portion and an outer surface of said container form a handle portion of said toothbrush, and wherein said container includes a housing, a chamber formed within said housing for containing a toothpaste and an aperture formed within a first end of said container and in fluid communication with said chamber for dispensing such toothpaste into said brush section when a predetermined manual force is applied to a predetermined wall portion of said container; and (g) an abutment formed within said first end of said elongated member and adjacent an inwardly disposed end of said brush section, wherein said first end of said container abuts a generally vertically surface of said abutment for sealing said aperture, and wherein said first end of said container is moved away from said elongated member and into a position for exposing said aperture and for dispensing such toothpaste into said brush section.

* * * * *